US006229487B1

(12) United States Patent
Sadler et al.

(10) Patent No.: US 6,229,487 B1
(45) Date of Patent: May 8, 2001

(54) INVERTED-F ANTENNAS HAVING NON-LINEAR CONDUCTIVE ELEMENTS AND WIRELESS COMMUNICATORS INCORPORATING THE SAME

(75) Inventors: Robert A. Sadler, Raleigh; Gerard James Hayes, Wake Forest, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/512,114

(22) Filed: Feb. 24, 2000

(51) Int. Cl.[7] ..... H01Q 1/38
(52) U.S. Cl. ..... 343/700 MS; 343/702; 343/846
(58) Field of Search ..... 343/700 MS, 702, 343/829, 846; H01Q 1/24, 1/38

(56) References Cited

U.S. PATENT DOCUMENTS 5,365,246 * 11/1994 Rasinger et al. ..... 343/702
5,966,097 * 10/1999 Fukasawa et al. ..... 343/700 MS
5,977,916 * 11/1999 Vannatta et al. ..... 343/702
6,040,803 * 3/2000 Spall ..... 343/700 MS

* cited by examiner

*Primary Examiner*—Tho Phan
(74) *Attorney, Agent, or Firm*—Myers Bigel Sibley & Sajovec

(57) ABSTRACT

Planar inverted-F antennas having planar, non-linear conductive elements for use within communications devices, such as radiotelephones, are provided. Each planar, non-linear conductive element includes a first elongated segment and a second elongated segment in adjacent, co-planar, spaced-apart relationship with each other. A U-shaped intermediate segment electrically connects the first and second elongated segments. A signal feed extends outwardly from the first segment and is configured to electrically connect with RF circuitry within a communications device. A ground feed also extends outwardly from the first segment adjacent the signal feed and is configured to electrically ground the non-linear conductive element to a ground plane.

15 Claims, 4 Drawing Sheets

INVERTED-F ANTENNAS HAVING NON-LINEAR CONDUCTIVE ELEMENTS AND WIRELESS COMMUNICATORS INCORPORATING THE SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

In addition, it is becoming desirable for radiotelephones to be able to operate within multiple frequency bands in order to utilize more than one communications system. For example, GSM (Global System for Mobile) is a digital mobile telephone system that operates from 880 MHz to 960 MHz. DCS (Digital Communications System) is a digital mobile telephone system that operates from 1710 MHz to 1880 MHz. The frequency bands allocated for cellular AMPS (Advanced Mobile Phone Service) and D-AMPS (Digital Advanced Mobile Phone Service) in North America are 824–894 MHz and 1850–1990 MHz, respectively. Since there are two different frequency bands for these systems, radiotelephone service subscribers who travel over service areas employing different frequency bands may need two separate antennas unless a dual-frequency antenna is used.

Inverted-F antennas are designed to fit within the confines of radiotelephones, particularly radiotelephones undergoing miniaturization. As is well known to those having skill in the art, inverted-F antennas typically include a linear (i.e., straight) conductive element that is maintained in spaced apart relationship with a ground plane. Examples of inverted-F antennas are described in U.S. Pat. Nos. 5,684,492 and 5,434,579 which are incorporated herein by reference in their entirety.

Conventional inverted-F antennas, by design, resonate within a narrow frequency band, as compared with other types of antennas, such as helices, monopoles and dipoles. In addition, conventional inverted-F antennas are typically large. Lumped elements can be used to match a smaller non-resonant antenna to an RF circuit. Unfortunately, such an antenna would be narrow band and the lumped elements would introduce additional losses in the overall transmitted/received signal, would take up circuit board space, and add to manufacturing costs.

High dielectric substrates are commonly used to decrease the physical size of an antenna. Unfortunately, the incorporation of higher dielectrics can reduce antenna bandwidth and may introduce additional signal losses. As such, a need exists for small, internal radiotelephone antennas that can operate within multiple frequency bands, including low frequency bands.

SUMMARY OF THE INVENTION

In view of the above discussion, the present invention can provide compact, planar inverted-F antennas having non-linear conductive elements for use within communications devices, such as radiotelephones. As used throughout, a "non-linear" conductive element is a conductive element that is not straight (e.g., bent or curved). A non-linear conductive element includes a first elongated segment and a second elongated segment in adjacent, co-planar, spaced-apart relationship with each other. An intermediate segment electrically connects the first and second elongated segments. The intermediate segment has a U-shaped (or other multi-direction) configuration.

A signal feed extends outwardly from the first segment and is configured to electrically connect with RF circuitry within a communications device. A ground feed also extends outwardly from the first segment adjacent the signal feed and is configured to electrically ground the non-linear conductive element to a ground plane.

By adjusting the width of the various segments of the non-linear conductive element, various resonating frequency bands can be obtained to facilitate multiple frequency band operation. For example, one elongated segment may be wider (or narrower) than the other elongated segment. Furthermore, an intermediate segment may be wider (or narrower) than the first and/or second elongated segments.

According to additional embodiments of the present invention, non-linear conductive elements may be disposed on or within a dielectric substrate.

Antennas according to the present invention may be particularly well suited for use within a variety of communications systems utilizing different frequency bands. Furthermore, because of their compact size, antennas according to the present invention may be easily incorporated within small communications devices. In addition, antenna structures according to the present invention may not require additional impedance matching networks.

DETAILED DESCRIPTION OF THE INVENTION

Figure 1:
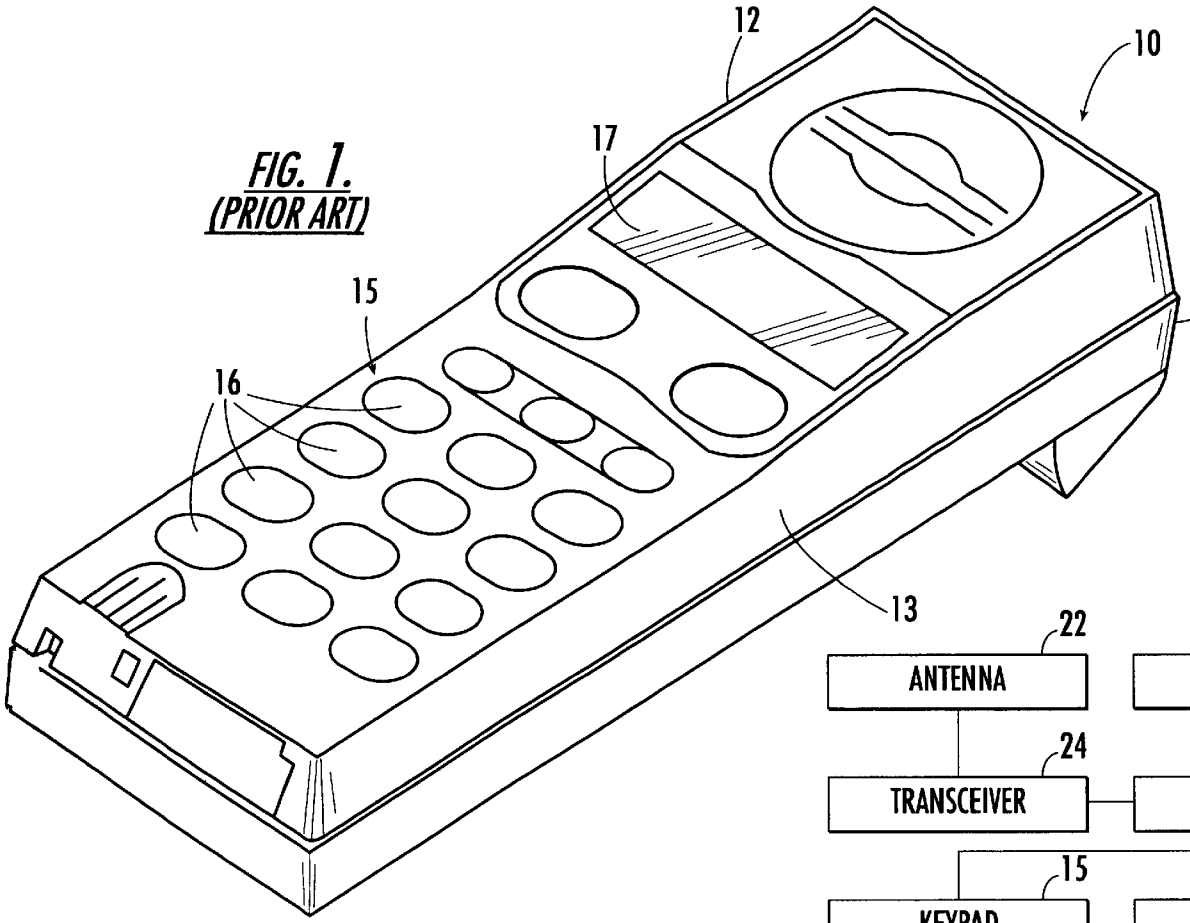
FIG. 1. (PRIOR ART)
FIG. 1 is a perspective view of an exemplary radiotelephone within which an antenna according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another element, there are no intervening elements present. Moreover, each embodiment described and illustrated herein includes its complementary conductivity type embodiment as well.

Referring now to FIG. 1, a radiotelephone 10, within which antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

Figure 2:
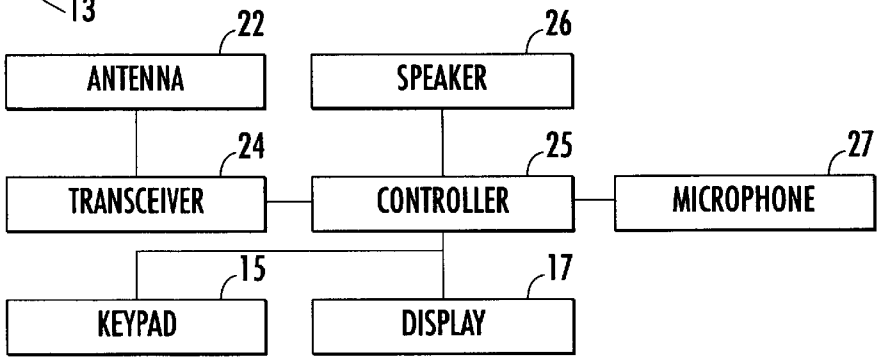
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 3A:
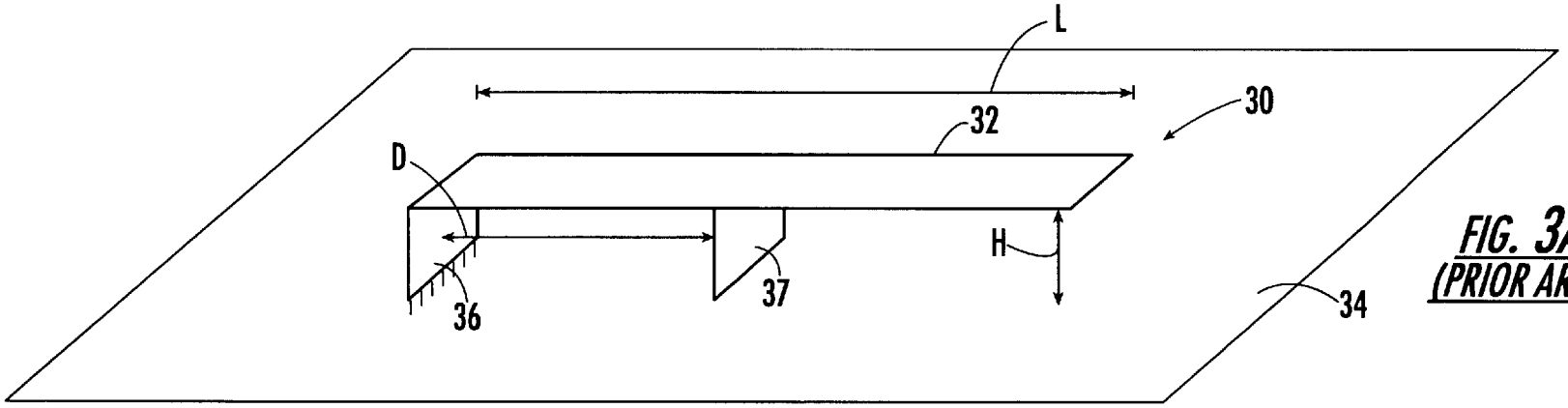
FIG. 3A. (PRIOR ART)
FIG. 3A is a perspective view of a conventional planar inverted-F antenna.
Figure 3B:
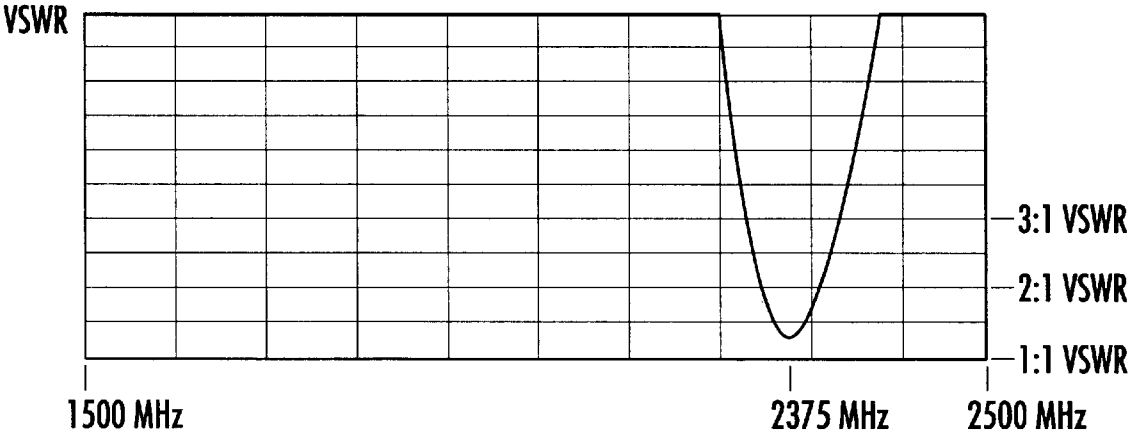
FIG. 3B is a graph of the VSWR performance of the antenna of FIG. 3A.

Referring now to FIG. 3A, a conventional planar inverted-F antenna is illustrated. The illustrated antenna 30 includes a linear conductive element 32 maintained in spaced apart relationship with a ground plane 34. Conventional inverted-F antennas, such as that illustrated in FIG. 3A, derive their name from a resemblance to the letter "F." The illustrated conductive element 32 is grounded to the ground plane 34 as indicated by 36. A hot RF connection 37 extends from underlying RF circuitry through the ground plane 34 to the conductive element 32. FIG. 3B is a graph of the VSWR performance of the inverted-F antenna 30 of FIG. 3A. As can be seen, the antenna 30 resonates at about 2375 Megahertz (MHz).

Figure 4A:
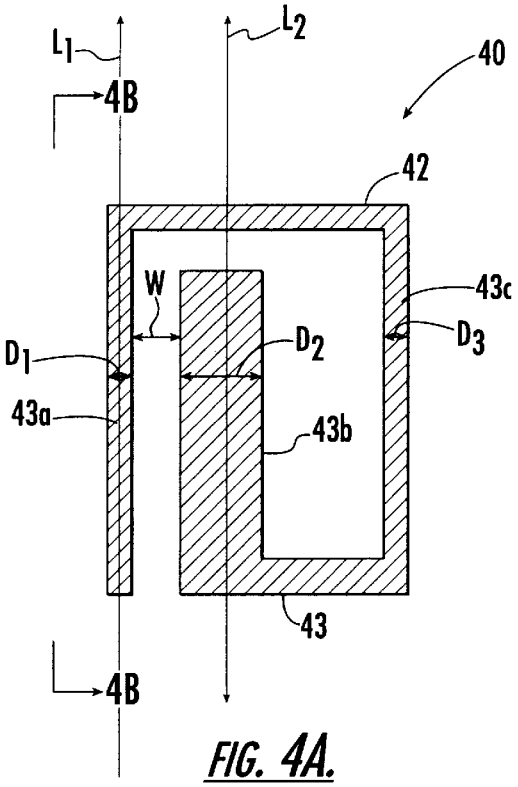
FIG. 4A is a top plan view of an inverted-F antenna having a non-linear conductive element according to an embodiment of the present invention.

Referring now to FIG. 4A, a planar inverted-F antenna 40 having a compact, non-linear configuration according to an embodiment of the present invention, is illustrated. The illustrated antenna 40 includes a planar, non-linear conductive element 42 having opposite first and second surfaces 42*a*, 42*b*. The illustrated planar, non-linear conductive element 42 includes a first elongated segment 43*a*, a second elongated segment 43*b*, and an intermediate segment 43*c* with a U-shaped configuration that connects the first and second elongated segments 43*a*, 43*b*. The first elongated segment 43*a* extends along a first direction $L_1$. The second elongated segment 43*b* extends along a second direction $L_2$ and is in adjacent, co-planar, spaced-apart relationship with the first elongated segment 43*a*, as illustrated. The illustrated U-shaped intermediate segment 43*c* is also co-planar with the first and second elongated segments 43*a*, 43*b*.

Figure 4C:
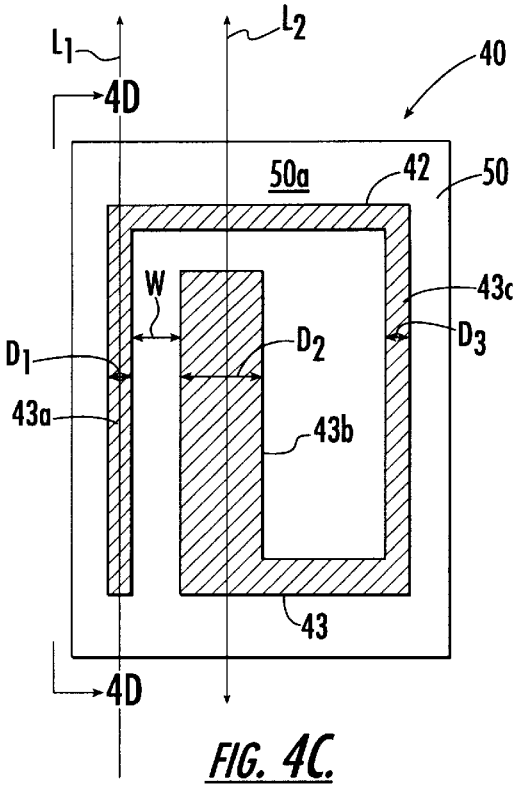
FIG. 4C is a top plan view of a dielectric substrate having a non-linear conductive element disposed thereon, according to another embodiment of the present invention.
Figure 4B:
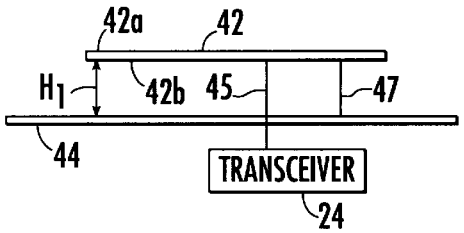
FIG. 4B is a side elevation view of the antenna of FIG. 4A taken along lines 4B–4B and illustrating the antenna in spaced-apart, adjacent relationship with a ground plane within a communications device.

Referring now to FIG. 4B, the antenna 40 of FIG. 4A is illustrated in an installed position within a wireless communications device, such as a radiotelephone. The planar conductive element 42 is maintained in adjacent, spaced-apart relationship with a ground plane 44. A signal feed 45 electrically connects the conductive element 42 to an RF transceiver 24 within a wireless communications device. A ground feed 47 grounds the conductive element 42 to the ground plane 45. The distance $H_1$ between the conductive element 42 and the ground plane 44 is preferably maintained at between about 2 mm and about 10 mm.

Referring back to FIG. 4A, preferably the first and second elongated segments 43*a*, 43*b* are spaced apart from each other by a distance of less than or equal to about 10 mm (indicated as W). In the illustrated embodiment, the first and second directions $L_1$ and $L_2$ are substantially parallel. However, the first and second directions $L_1$ and $L_2$, along which the first and second elongated segments 43*a*, 43*b* extend, respectively, need not be parallel.

In the illustrated embodiment, the first and second elongated segments 43*a*, 43*b* have generally rectangular configurations. However, the first and second elongated segments 43*a*, 43*b* may have virtually any configuration and are not limited to the illustrated rectangular configurations. The illustrated first elongated segment 43*a* has a first width $D_1$ and the second elongated segment 43*b* has a second width $D_2$ that is greater than the first width $D_1$.

According to another embodiment, illustrated in FIG. 4C, the planar, non-linear conductive element 42 may be formed on a dielectric substrate 50, for example by etching a metal layer formed on the dielectric substrate. An exemplary material for use as a dielectric substrate 50 is FR4 or polyimide, which is well known to those having skill in the art of communications devices. However, various other dielectric materials also may be utilized. Preferably, the dielectric substrate 50 has a dielectric constant between about 2 and about 4. However, it is to be understood that dielectric substrates having different dielectric constants may be utilized without departing from the spirit and intent of the present invention.

Figure 4D:
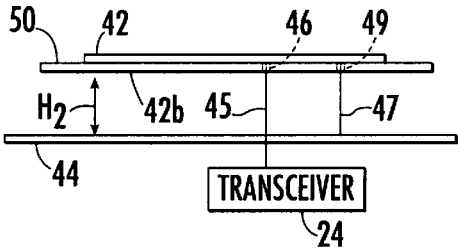
FIG. 4D is a side elevation view of the antenna of FIG. 4C in adjacent, spaced-apart relation with a ground plane within a communications device.

Referring now to FIG. 4D, the antenna 40 of FIG. 4C is illustrated in an installed position within a wireless communications device, such as a radiotelephone. The dielectric substrate 50 having a conductive element 42 disposed thereon is maintained in adjacent, spaced-apart relationship with a ground plane 44. A signal feed 45 extends through an aperture 46 in the dielectric substrate and electrically connects the conductive element 42 to an RF transceiver 24. A ground feed 47 extends through another aperture 49 in the dielectric substrate and electrically grounds the conductive element 42 to the ground plane 44. The distance $H_2$ between the dielectric substrate 50 and the ground plane 44 is preferably maintained at between about 2 mm and about 10 mm.

Figure 5:
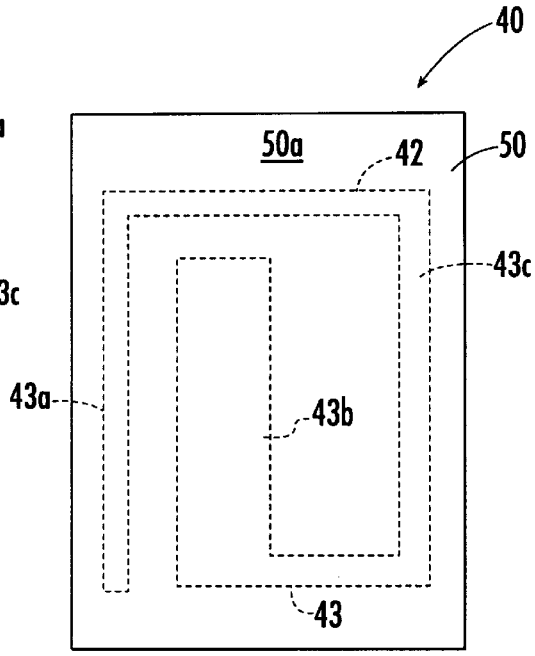
FIG. 5 is a top plan view of a dielectric substrate having a non-linear conductive element disposed therein, according to another embodiment of the present invention.

According to another embodiment of the present invention, a planar, non-linear conductive element 42 may be disposed within a dielectric substrate 50 as illustrated in FIG. 5.

A preferred conductive material out of which the non-linear conductive element 42 of FIGS. 4A–4D and FIG. 5 may be formed is copper. For example, the conductive element 42 may be formed from copper foil. Alternatively, the conductive element 42 may be a copper trace disposed on a substrate, as illustrated in FIGS. 4C and 4D. However, a non-linear conductive element according to the present invention may be formed from various conductive materials and is not limited to copper.

The thickness of the planar, non-linear conductive element 42 illustrated in FIGS. 4A–4D and FIG. 5 is typically 0.5 ounce (14 grams) copper. However, the non-linear conductive element 42 illustrated in FIGS. 4A–4D and FIG. 5 may have various thicknesses.

Figure 4E:
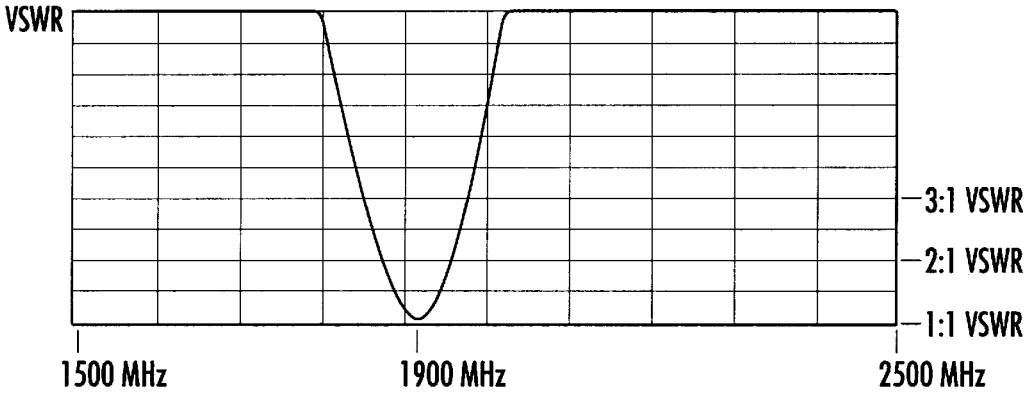
FIG. 4E is a graph of the VSWR performance of the antenna of FIG. 4A.

Referring now to FIG. 4E, the illustrated antenna 40 of FIGS. 4A–4D and FIG. 5 is configured to resonate around 1900 MHz. The non-linear configuration of the conductive element 42 allows the antenna 40 to resonate at a lower frequency band than conventional inverted-F antennas having a linear conductive radiating element. The bandwidth of the antenna 40 may be adjusted by changing the shape, length, and configuration of the first, second and intermediate segments 43*a*, 43*b*, 43*c* of the non-linear conductive element 42. In addition, the bandwidth of the antenna 40 may be adjusted by changing the respective widths $D_1$, $D_2$ of the first and second elongated segments 43*a*, 43*b* and/or by adjusting the spaced-apart distance W between the co-planar first and second elongated segments 43*a*, 43*b*.

Figure 6A:
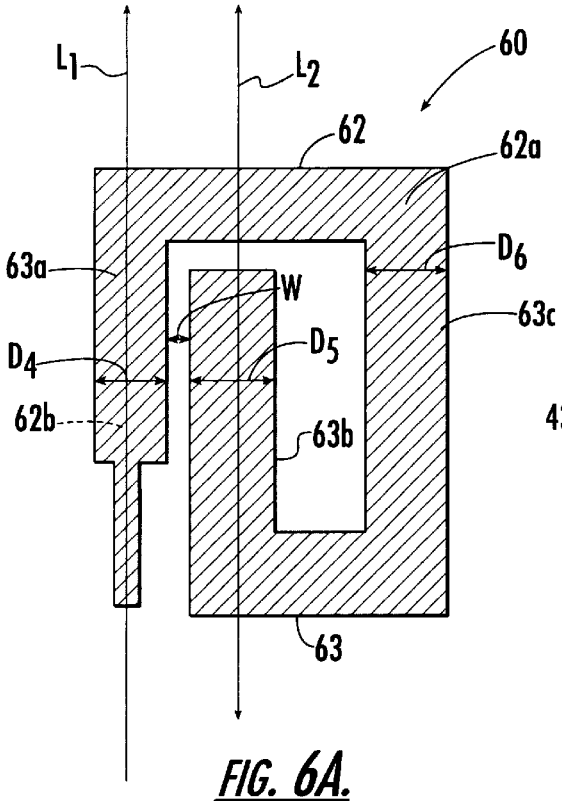
FIG. 6A is a top plan view of an inverted-F antenna having a non-linear conductive element having a configuration according to another embodiment of the present invention.

Referring now to FIG. 6A, a planar inverted-F antenna 60 having a compact, non-linear configuration according to another embodiment of the present invention, is illustrated. The illustrated antenna 60 includes a planar, non-linear conductive element 62 having opposite first and second surfaces 62*a*, 62*b*. The illustrated non-linear conductive element 62 includes a first elongated segment 63*a*, a second elongated segment 63*b*, and an intermediate segment 63*c* with a U-shaped configuration that connects the first and second elongated segments 63*a*, 63*b*. The first elongated segment 63*a* extends along a first direction $L_1$. The second elongated segment 63*b* extends along a second direction $L_2$ and is in adjacent, co-planar, spaced-apart relationship with the first elongated segment 63*a*, as illustrated. The illustrated U-shaped intermediate segment 63*c* is also co-planar with the first and second elongated segments 63*a*, 63*b*.

In the illustrated embodiment, the first and second directions $L_1$ and $L_2$ are substantially parallel. However, the first and second directions $L_1$ and $L_2$, along which the first and second elongated segments 63*a*, 63*b* extend, respectively, need not be parallel.

Figure 6B:
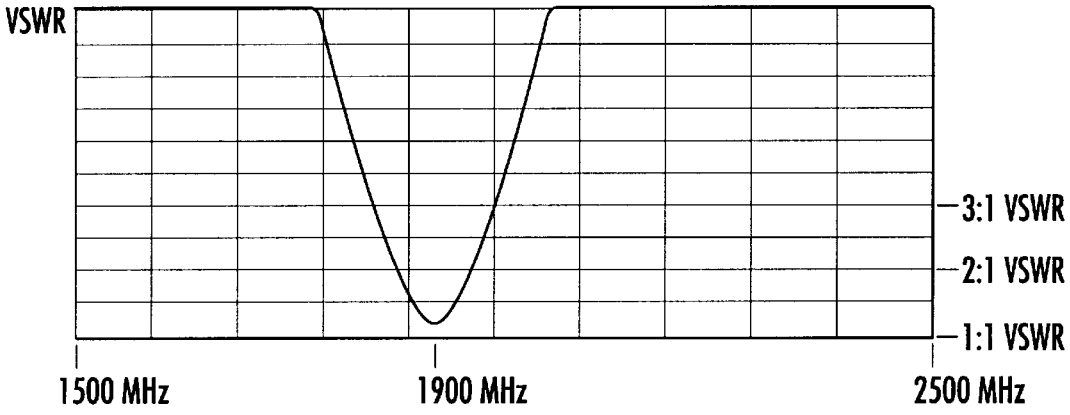
FIG. 6B is a graph of the VSWR performance of the antenna of FIG. 6A.

In the illustrated embodiment, the width $D_4$ of the first elongated segment 63*a* and the width $D_6$ of the intermediate segment 63*c* have been increased as compared with the antenna 40 of FIGS. 4A–4D. The increased width of the first and intermediate segments 63*a*, 63*c* causes the antenna 60 to resonate with a broader bandwidth as compared with the antenna 40 of FIGS. 4A–4D. For example, as illustrated in FIG. 6B, the illustrated antenna 60 of FIGS. 6A and 6B resonates at PCS band (1850–1990 MHz).

It is to be understood that the present invention is not limited to the illustrated configurations of the non-linear conductive elements 42, 62 of FIGS. 4A and 6A, respectively. Various other non-linear configurations may be utilized, without limitation. For example, the intermediate segments 43*c*, 63*c* may have a Z-shape, or a curved or meandering shape. In addition, the width of a non-linear conductive element according to the present invention may vary (either widened or narrowed), and need not remain constant.

Antennas according to the present invention may also be used with wireless communications devices which only transmit or receive radio frequency signals. Such devices which only receive signals may include conventional AM/FM radios or any receiver utilizing an antenna. Devices which only transmit signals may include remote data input devices.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A planar inverted-F antenna, comprising:

a planar dielectric substrate;

a planar, conductive element disposed on the planar dielectric substrate, wherein the conductive element comprises:

a first elongated segment extending along a first direction;

a second elongated segment extending along the first direction in adjacent, co-planar, spaced-apart relationship with the first elongated segment; and an intermediate segment having a U-shaped configuration electrically connecting the first and second elongated segments;

a signal feed electrically connected to the conductive element first elongated segment and extending outwardly from the conductive element through the planar dielectric substrate; and a ground feed electrically connected to the conductive element first elongated segment adjacent the signal feed and extending outwardly from the conductive element through the planar dielectric substrate.

2. The antenna according to claim 1 wherein the second elongated segment is spaced apart from the first elongated element by a distance of less than or equal to about ten millimeters (10 mm).

3. The antenna according to claim 1 wherein the first elongated segment has a first width, and wherein the second elongated segment has a second width greater than the first width.

4. The antenna according to claim 1 wherein the first elongated segment has a first width, and wherein the second elongated segment has a second width equal to the first width.

5. The antenna according to claim 1 wherein the conductive element is disposed on a dielectric substrate.

6. The antenna according to claim 1 wherein the conductive element is disposed within a dielectric substrate.

7. The antenna according to claim 1 wherein the first and second elongated segments have respective rectangular-shaped configurations, and wherein the first and second elongated segments are in parallel, spaced apart relationship.

8. A wireless communicator, comprising:

a housing configured to enclose a transceiver that transmits and receives wireless communications signals;

a ground plane disposed within the housing; and a planar inverted-F antenna disposed within the housing and electrically connected with the transceiver, wherein the antenna comprises:

a planar dielectric substrate;

a planar, non-linear conductive element disposed on the planar dielectric substrate, wherein the non-linear conductive element comprises:

a first elongated segment extending along a first direction;

a second elongated segment extending along the first direction in adjacent, co-planar, spaced-apart relationship with the first elongated segment; and an intermediate segment having a U-shaped configuration electrically connecting the first and second elongated segments;

a signal feed electrically connected to the first elongated segment and extending outwardly from the non-linear conductive element through the planar dielectric substrate; and a ground feed electrically connected to the first elongated segment adjacent the signal feed and extending outwardly from the non-linear conductive element through the planar dielectric substrate.

9. The wireless communicator according to claim 8 wherein the second elongated segment is spaced apart from the first elongated element by a distance of less than or equal to about ten millimeters (10 mm).

10. The wireless communicator according to claim 8 wherein the first elongated segment has a first width, and wherein the second elongated segment has a second width greater than the first width.

11. The wireless communicator according to claim 8 wherein the first elongated segment has a first width, and wherein the second elongated segment has a second width equal to the first width.

12. The wireless communicator according to claim 8 wherein the non-linear conductive element is disposed on a dielectric substrate.

13. The wireless communicator according to claim 8 wherein the non-linear conductive element is disposed within a dielectric substrate.

14. The wireless communicator according to claim 8 wherein the first and second elongated segments have respective rectangular-shaped configurations, and wherein the first and second elongated segments are in parallel, spaced apart relationship.

15. The wireless communicator according to claim 8 wherein the wireless communicator comprises a radiotelephone.

* * * * *